114-253
1/24/78 XR SR 4,069,786

United States Patent [19]

La Botz

[11] 4,069,786

[45] Jan. 24, 1978

[54] WATER SKI TOWING MEANS

[76] Inventor: Richard John La Botz, 5084 Cocoa Palm Way, Fair Oaks, Calif. 95628

[21] Appl. No.: 704,241

[22] Filed: July 12, 1976

[51] Int. Cl.[2] ..... A63C 11/10; B63B 21/56

[52] U.S. Cl. ..... 115/6.1; 114/253; 9/310 R

[58] Field of Search ..... 9/310 R, 310 A, 310 B; 115/6.1; 114/235 WS, 253

[56] References Cited

U.S. PATENT DOCUMENTS

| | | | |
|---|---|---|---|
| 3,125,060 | 3/1964 | Leonard | 9/310 R X |
| 3,142,075 | 7/1964 | Hill | 9/310 C |
| 3,227,126 | 1/1966 | Etzler | 9/310 C |
| 3,242,897 | 3/1966 | Leonard | 9/310 R X |
| 3,380,425 | 4/1968 | Wilson | 114/235 WS |
| 3,807,342 | 4/1974 | Turner | 9/310 B X |

FOREIGN PATENT DOCUMENTS

| | | | |
|---|---|---|---|
| 932,071 | 7/1963 | United Kingdom | 9/310 C |

*Primary Examiner*—Stephen G. Kunin
*Assistant Examiner*—Edward M. Wacyra
*Attorney, Agent, or Firm*—Mark C. Jacobs

[57] ABSTRACT

An improved water skiing tow device is provided, wherein a rigid tubular member is employed to keep the two trace-reins apart, near the bight of the device. The device includes a cross rope arcuate portion and the arcuate portion is intended to be in engagement with a triangular block on each water ski prior to planing and to be released therefrom when the skier is planing in the water.

16 Claims, 11 Drawing Figures

WATER SKI TOWING MEANS

BACKGROUND OF THE INVENTION

This invention relates to a water ski towing device and more particularly to a towing rig especially intended for use by 1 or 2 ski water skiers. The device is particularly adapted for use by skiers employing relatively underpowered tow boats, and for use by skiers who commence ascent from a side start.

While the sport of water skiing has been enjoying increased growth as the cost of obtaining the use of a boat has declined, full enjoyment of the sport by all participants is inhibited by the difficulties that are encountered during the starting or "pull-out" stage. Not only is the skier required to have a sense of balance and agility, but the skier must practice starting a great deal even if he is a talented skier. Those who desire to participate in skiing on one ski must possess additional skill and stamina, for water skiing if not carried out correctly can be very tiring, and in some cases can lead to injury.

A major defect of the prior art systems is that they require the skier to employ special attachments to the ski while the skier is in the water. One such water ski starting device known to the inventor is that of Leonard, U.S. Pat. No. 3,125,060. That device prevents the skis from spreading apart on start-up by forming a clamp around the outer edges of the ski pair. The handle of this device is a U-shaped member quite different from the standard handle.

Another known towing device is that of Hill, U.S. Pat. No. 3,142,075. Heretoo a nonstandard handle member is employed, and the device is actually releaseably connected to the skis by a hitch.

Still another towline system is that of Turner, U.S. Pat. No. 3,807,342. This patent references a maneuvering towing system for water sleds primarily.

SUMMARY OF THE INVENTION

The instant invention consists of a conventional tow rope, having either one or two handles, both types of which are known in the art, said tow rope being modified to include a splitter and a cross-rope, both of which will be described in more detail infra. The third portion of the invention is a pair of stop blocks which are substantially triangular (right angle), and which are permanently secured, one per ski, to the forward part of the top surface of the ski, ahead of the binding.

The splitter comprising a short length (3 to 7 inches being normal practice) of a tubular member such as rigid plastic (styrene, ABS, PVC, etc., or metal not affected by water or salt) which is attached to the forward end of the yoke. The splitter is attached by running a length of rope through the tubular member and then attaching the rope length to a point on one side of the rig downstream from the yoke by a conventional splicing technique. The attachment point is about 4 to 7 inches from the yoke. The balance of the rope length that exists from the tube is fed down the middle of the other side of the main rig after the splitter is secured in place by a knot or splice. The rope length emerges at a point further down stream on this second side, is permitted to form a loose loop and is fed into the first side of the rig at a point opposite the emergence point on the second side of the rig. The rope length passes up the middle of the first side of the rig to a point downstream from the splitter where it is secured by a splice or at least one knot to the first side of the rig. The loose loop constitutes the cross-rope referred to previously.

The invention further includes a generally triangular solid stop member, of plastic or metal which is affixed to each ski at the forward section thereof. A further description of the stop member and its function and operation is recited infra.

It is a major object therefore of this invention to provide an improved tow rope device for water skiers.

It is another object of this invention to provide a device that while unburdening the skier during start-up, has the feel and operability of a conventional tow rope.

One other object is to provide a ski starting device which does not require the skier to attach the rope to the ski prior to starting.

Another object is to provide a device that splits the load between the skier and ski during startup.

A further object is to provide a tow rig which aids the skier during pull-out, but which allows him to ski in a normal fashion after he has emerged from the water.

A still further object is to provide a towing rig that is easily employable with underpowered boats.

Yet another object is to provide a device, especially adapted to one ski skiers for employing side pull-ups.

One other object is to provide an improved towing rig that is automatically released from the ski(s) without any effort on the part of the skier.

For a more complete understanding of the instant invention, reference is made to the following detailed description taken in conjunction with the accompanying drawings wherein like numeral designators indicate the same or similar parts throughout the plurality of views presented.

FIG. **4*a*** depicts the skier prior to pull-up, with the cross-rope hanging slack and not engaged.

FIG. **4*b*** shows the skier during pull-out with the cross-rope engaged on the stop block.

FIG. **4*c*** shows pull-up completed, the cross-rope disengaged and the skier skiing in normal fashion.

**4*D* is a closeup view of 4*b***.

Figure 5:
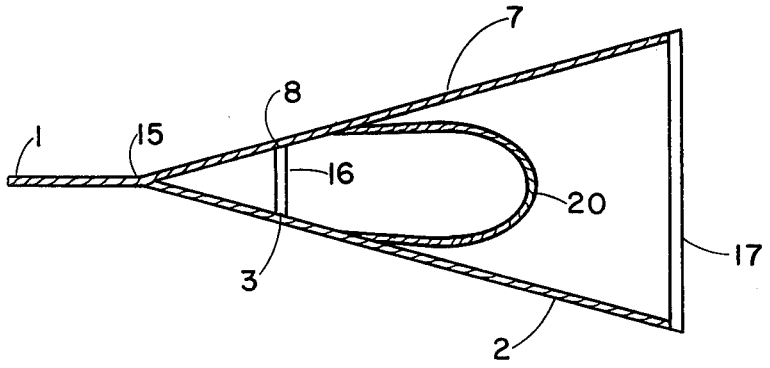

FIG. 5 illustrates a single handle embodiment of the instant invention in a top plan view.

FIGS. **6*a* and 6*b*** diagramatically illustrate a normal pull-up and an angular pull-up of a water skier, respectively.

Figure 7:
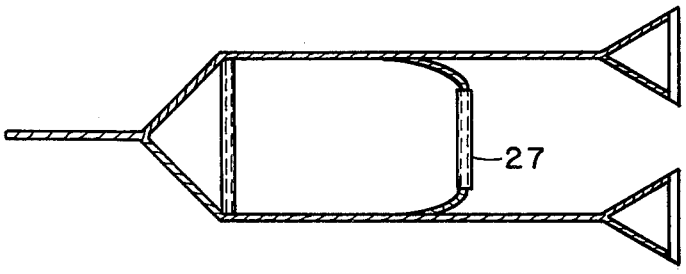

FIG. 7 is a perspective view of an alternative embodiment of this invention specifically intended for two-ski skiers and which employs a pair of handles.

DESCRIPTION OF THE PREFERRED EMBODIMENT

The following discussion is intended to set forth in detail one embodiment of the present invention, with the understanding that the invention is not limited to the specific details depicted herein. Designation 1, denotes the main tow line connected to a prime mover such as from the stern of a motorboat (not shown) for the purpose of towing a rider on a ski or skis, (not shown here) but illustrated in FIG. 4. Main tow line 1 divides itself into a towing yoke which includes traces 2 and 7 diverging rearwardly from a bight 15. The rearward ends of the traces 2 and 7 are connected to end portions of a transversely disposed splitter tube 16 by a rope 20 positioned down the bore of splitter 16 said rope 20 being spliced to the rearward end of trace 7 and spliced to the rearward end of trace 2, at a terminal and intermediate portions of rope 20, respectively. Reins 18 and 19 may constitute continuations of the ropes forming traces 7 and 2, respectively. Trace-reins 7–18, and 2–19 comprise multistrand monofilament ropes made of, for example, polypropylene or polyethylene. While a single length of rope is preferred for the traces and reins pairs, individual ropes can likewise be employed for each trace and each rein. Each rein further divides at a sub-bight into a pair of handle assemblies 101 and 102. Rein 18 divides into handlines 10 and 9 while rein 19 divides into handlines 4 and 5, at bights 21 and 22, respectively. These handlines depend rearwardly from the bights 21 and 22. Elongated handles 11 and 6 are connected at the terminal portions of the handles to the handlines. Handle 11 is connected to handlines 10 and 9 at junctions 10*a* and 9*a* respectively, and handle 6 is connected at its extremities to handlines 4 and 5 and junctions 4*a* and 5*a*, as by knots or adhesive. Alternatively, handlines 4 and 9 can be omitted and handles 6 and 4 can be end to end to form one handle as is known in the art.

Rope 20 after being secured as by splicing it to rein 18 at splice 23*a* and then engresses about 90° leftwardly. The splitter 16 which has a central bore of a greater diameter than rope 20 is inserted thereup, and rope 20 is inserted at point 219, a distance from bight 15 equal to the distance of point 718 from said bight 15, is spliced to said rein at splice 23*c* and reinserted therein to continue on a rearwardly path. Rope 20 is fed down the core, not shown of rein 19 until it exits at junction 3 where it now continues as a loose loop and is designated cross-rope 20. This rope is braided into and enters the core of rein 18 at junction 8, a point equidistant with junction 3 from the extremities of the transverse splitter 16. Rope 20 is disposed along the core of rein 18 to a point 23*b* whereupon it exits from the braid and is secured at point 23*b* to rein 18 with one or more knots or by a splice.

It is seen that the total length of rope 20 can vary from a length of about 4 feet or greater. The splitter is positioned such that its midpoint is about 4 to 7 inches from bight 15 with a distance of about 5 inches being preferred. It is also to be noted that the distance from junctions 3 and 8 respectively, to the midpoints of handles 6 and 11, respectively, is between 15 and 30 inches, with 20 inches being the most desirable amount.

The splitter 16 is retained in position at the terminal portion of traces 2 and 7 by the interengagement of the rope 20 at points 718 and 219, said rope 20 being positioned down the central bore of said splitter, and extending from one side thereof to the other as discussed above.

It is believed that the distance from the points of egress and entrance of the crossrope 20 from each rein, i.e., at points 3 and 8, to the points 718 and 219, can vary from about a minimum of 6 inches to as much as several feet. The minimum amount is suggested in view of the fact that smaller distances render it difficult for the ski to slip freely between the reins and splitter. It has been found that a distance of about 10 to 14 gives satisfactory results, without being clumsy.

The arcuate portion of the crossrope that hangs free between points 8 and 3 bears no relationship to the total length of rope employed for the crossrope. However, this portion of the crossrope should be between 20 and 30 inches in order to ensure that the crossrope remains engaged at the point in time that the reins are being elevated above the ski as the skier is coming out of the water to a planing position and until the ski has moved from its original almost 60° angle to the surface of the water until it reaches about a 30° inclination or a time period of several seconds.

OPERATION

Figure 4A:
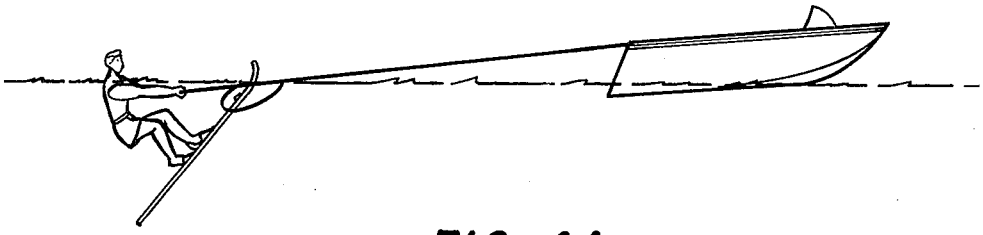
FIG. 4 illustrates in three steps the operation of the instant device.
Figure 4B:
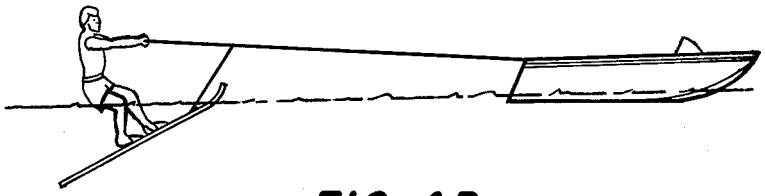
Figure 4C:
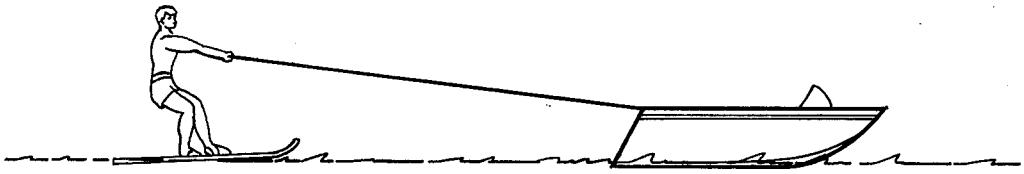
Figure 4D:
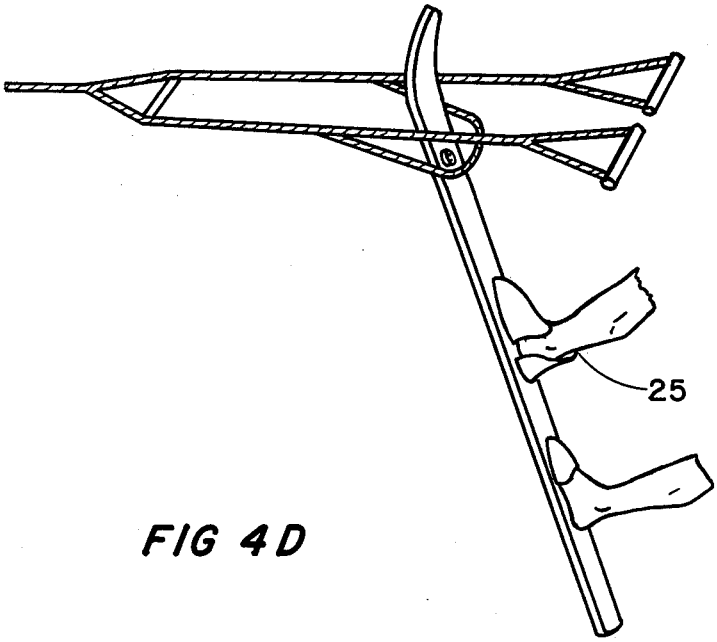

The operation of the instant invention and its use is pulling up the skier to the full water skiing position to where he or she is standing erect and planing across the water from a normal deep water start is readily seen. Reference is made specifically to FIG. 4*a* wherein the skier is deep in the water; FIG. 4*b* wherein the crossrope 20 is releaseably engaged with the stop 14; and FIG. 4*c* wherein the crossrope has been released.

FIG. 4*a* shows the water skier 25 in the correct starting position. That is, the skier aligns the forward tip of the water ski between the splitter 16 and the crossrope 20. Towline 1 is essentially slack at this point in time. It is seen that other than the step of tip alignment discussed above, the positioning of a skier is as with the use of a conventional tow rope. As the skier's boat slowly pulls the slack from the towline the skier 25 holds the handles 6 & 11 (or 17 handle in a one handle embodiment) low enough such that the crossrope 20 rests on the ski 12 behind stop member 14. As power is further applied by the prime mover, the tow rope 1 pulls taut. Crossrope 20 moves forwardly on the ski 12 until it lodges behind member 14 and becomes releasably positioned on the rear side thereof. At this moment in time, the pull from the tow rope is divided between the ski and the skier. Reference is made to FIG. 4*a*.

At this stage in the ascent process, the crossrope 20 serves the skier in several ways. Since the pull from the tow rope 1 is very high (frequently 1.5 times the skier's body weight) the action of the crossrope of this invention in applying a portion of load directly to the ski acts to significantly reduce the strain on the skier 25.

In addition, the crossrope 20 serves to keep the ski in the correct attitude. It is seen that if the inexperienced skier 25, leans too far back, he in essence attempts to take the pulling load away from the crossrope 20, thereby producing a marked increase in the load he must sustain. If however, he leans too far forward, the tow load all transfers to the ski 12, and thus the skier 25 who has no load pulling him forward, is immediately pulled back to the proper position due to the drag of the water around him. Since the ski is seen to be being pulled by the ski rope, see FIG. 4*b*, there is reduced tendency for the ski to move to to one side or another.

As the boat and skier both achieve more speed, the ski begins to plane. As planing commences, the front of the ski begins to move forward relative to the skier whereby the load on the crossrope is reduced, until the time it actually goes slack. At this point in time, the tow rope 1's load is well below its maximum values and the skier has no difficulty in holding on the handle(s). See particularly FIG. 4*C*. As the ski becomes erect, the cross-rope becomes dislodged from the stop member 14 and hangs free. Now the skier is on his way, and the device operates similarly to a conventional towing rig during the balance of his skiing venture, until the next start-up.

The device of the instant invention is seen to aid a water skier in the pull-up stage, especially when but a single ski is employed, by transfering a portion of the load from the tow rope directly to the ski instead of through the skier to the ski. The tow rope pull is thus divided between the ski and skier, rather than having all of the load passing to the skier. When part of of the pulling force is applied directly to the ski, the skier finds that it is easier to maintain a grip on the handle, that his ski(s) goes in the desired direction, and that maintenance of the ski at the proper attitude is easier.

The instant device is designed such that the tow rope pulls on the ski only while the skier is starting up out of the water. Once he is out of the water and in an operative ski position, the tow rope no longer engages the ski and skier proceeds to ski as though he were skiing with an ordinary ski towing rig.

Figure 1:
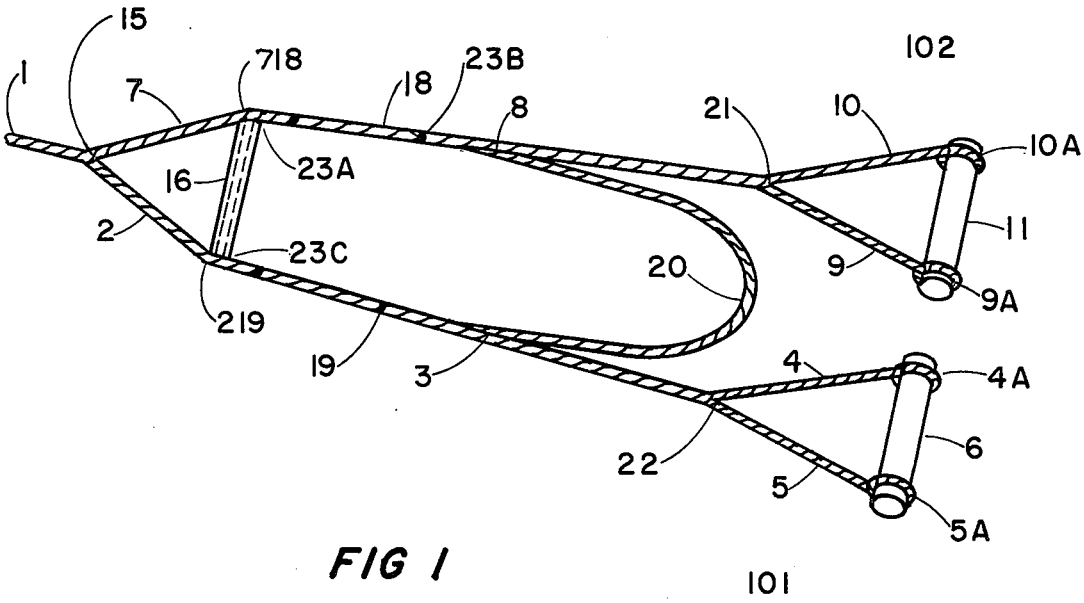
FIG. 1 is a perspective view of a double handled towing rig according to this invention.
Figure 2:
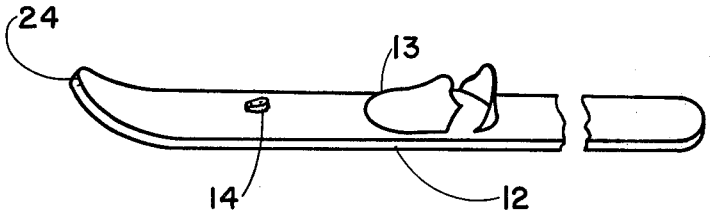
FIG. 2 is a perspective view of a water ski showing the mounting of the stop block forward of the front binding.
Figure 3:
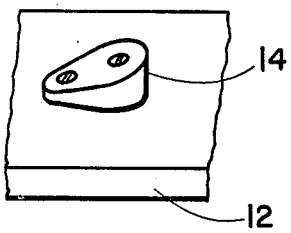
FIG. 3 is an enlarged fragmentary view of the front portion of a ski with the stop block affixed thereto.

The reason that the rig of this invention can operate in such a manner is specifically due to the interrelationship of the stop block 14 with the engaging means, i.e., crossrope 20. Note Specifically FIG. 3. This member 14 is a solid or hollow unit which includes an upstanding body portion projecting above the surface of the ski, and a base portion which is secured to the surface of the ski, said body being integral with and coextensive with same base. For esthetic reasons a polygonal solid of vertical cross section is desirable, preferably it has rounded off vertical corners to avoid ropes catching on the corners, to allow the crossrope 20 to slide across the rear wall of said block and center itself in releaseable engagement with said rear wall. To achieve releaseable engagement, the angle of inclination of the rear wall is 20° ± 10° measured from the vertical axis. Block 14 may have a downsloping top surface sloping toward the front of the ski. Said block is to be positioned equidistant from each side of the ski substantially midway between the binding 13 and the front tip of the ski 24. This block may be drilled for mounting with screws or it may be glued in place. Screws 25 are shown in the Figure. Typical materials for said block include Teflon® and nylon, and said block may be made as by injection molding.

The operation of the instant invention is keyed to the action of the engaging means, e.g., crossrope 20 engaging the stop 14. In the starting process, the skier keeps hands low enough such that crossrope 20 is below the stop 14 at the time of "application of boat power," a term known to the art, and commencing after the slack has been pulled from the tow rope. When the power is applied, the crossrope 20 pulls up against the ski, as by gliding forwardly until it engages the stop block 14. This gliding motion transpires in a fraction of a second. At that point in time of engagement, the crossrope commences applying a portion of the boat pull directly to the ski, and renders the pull on the skier less, guides the ski into a path in line with the tow rope and helps the skier to maintain a proper position leaning neither too far forward or too far rearward. Because the pull on the skier is decreased, it becomes easier for the skier to maintain his grip on the handle(s).

Figure 6A:
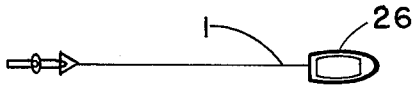
Figure 6B:
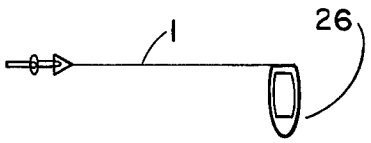

As previously indicated, the instant device renders pull-ups with an underpowered boat substantially easier than with conventional rigs. Reference to FIGS. 6*a* and 6*b*. Rather than have the underpowered boat 26 pull parallel to the ski rope 1 as shown in 6*a*, the boat 26 pulls at a <90° angle to the rope 1 as shown in 6*b*.

Such a start allows the boat 26 as in 6*b* to travel a considable distance and to achieve significant speed before it feels the full effect of the drag force of the skier. Thus the boat can achieve a planing condition before it begins to pull the skier out of the water. The skier 25, on the other hand is subjected to a smooth but gradual pull as the boat gains speed. With a conventional tow rig, difficulty can arise, since the skier 25 is being rotated while being pulled, he may turn as is necessary, but the ski(s) may go straight with the result that the skier is pulled sidewise off the ski(s) 12. When the instant device is employed, such that the crossrope 20 lodges behind stop member 14 as in the ordinary course of events, the ski is rotated at the same time the skier is being turned such that the sensation gained by the skier 25 is that he is being pulled straight.

During the course of discussion it has been indicated that the instant device can be utilized for one ski and two ski skiers. In order to employ the instant device for two ski skiers, however, it is necessary to lengthen the splitter, and lengthen the portion of crossrope from point 3 to point 8.

It is preferable however for two ski operation to employ the alternative equipment wherein the length of the splitter 16 is increased to approximately 15 inches while the crossrope 20 is adapted to incorporate a rigid member 27, as shown in FIG. 7. The use of the rigid member keeps the two skies from being driven towards each other by tension on rope 20 during the start-up process. The principal of incorporating such a rigid member may resemble the splitter in configuration, among others. Alternately, a flat member may be appended along the length thereof to the crossrope by securing means, e.g., clips.

In recapitulation it iseen that the construction and operation of the instant invention is based upon a study and the application of the hydrodynamic forces affecting a water skier. The lift and drag forces and the loads affecting the ski and skier are considered such that the skier is kept in a dynamically balanced position, not too forward and not too far back on the ski during the pull-out cycle. It is also seen that even though the skier is using a physical aid to achieve good start-up, no conscious effort is necessary to convert the aid to a conventional towing rig, since the dislodging of the crossrope 20 from stop member 14 is inherent in the operation of the device.

In an alternative embodiment, the crossrope, rather than exiting from the rein to enter the splitter, terminates at the junction of the splitter with each rein. In such instance, a solid member rather than a tubular one may be employed for the splitter. The splitter comprises a solid member with a slot on each end such that each rein may be inserted to be permanently affixed therein on each side.

It will be obvious to those skilled in the art that many variations may be made in the embodiment here chosen for the purpose of illustrating the present invention without departing from the scope thereof as defined by the appended claims.

What is claimed is:

1. In a water ski towing device of the type for towing a person on a ski(s) from an initial pull-out position to a planing position, a tow line assembly including a tow line adapted to be secured to a prime mover, a pair of trace-reins each connected on one end to said tow line, and on the opposite end connected to handle means, a splitter connected at its opposite ends to each of said trace-reins, each end of said splitter being equidistant from said tow line, and spaced apart from said handle means, and means connected at the opposite ends thereof to each of said trace-reins, being releasably engageable with a stop block(s) on said ski(s), said means being substantially longer than said splitter and having an arcuate portion therein.

2. In the water skiing device of claim 1 wherein the means connected to said trace-reins is a crossrope substantially longer than said splitter and thus forming an arcuate portion thereto.

3. In the water skiing device of claim 2 wherein a rigid member is appended to said crossrope along the length of said member to engage said stop blocks.

4. In the device of claim 3 wherein the distance from the opposite ends of said splitter to the tow line is substantially equal to the length of the splitter.

5. In a water skiing device of claim 2 wherein the arcuate portion of said crossrope is between 20 and 30 inches long.

6. In the water skiing device of claim 2 wherein the splitter is secured to the trace-reins by extensions of the cross-rope.

7. In the device of claim 2 wherein the cross-rope is secured to one trace-rein, from which point it passes through a central bore down the length of said splitter, becomes disposed within and secured to said second trace-rein at a point equidistant from said tow line as is the point of egress from said frist trace-rein just mentioned, is disposed rearwardly within said second trace-rein to a point of egress wherein it becomes disposed in a general direction toward said first trace-rein to a point on said first trace-rein substantially equidistant from said tow line as is said point of egress from said second trace-rein, at which it enters said first trace-rein and becomes disposed therein forwardly to a point of attachment on said first trace-rein, which point of attachment is downstream from the first point of securement of said rope to said first trace-rein.

8. In the device of claim 7 wherein the crossrope is secured to the trace-rein by splicing.

9. In the device of claim 7 wherein the distance from the opposite ends of said splitter to the tow line is substantially equal to the length of the splitter.

10. In the water skiing device of claim 2 wherein the crossrope is secured to the trace-reins by splicing.

11. In the device of claim 1 wherein the distance from the opposite ends of said splitter to the tow line is substantially equal to the length of the splitter.

12. In the device of claim 1 wherein the trace-reins terminate at the opposite ends thereof in handle means of one or more handle assemblies.

13. A water ski towing device for towing a person on a ski(s) from an initial pull-out position to a planing position comprising in combination with said ski(s) a stop block secured to the toe portion of each water ski, said stop block including a base for securing said block to said ski, and an upstanding body portion projecting above the surface of said ski and integral with said base, and the tow line assembly of claim 1, wherein said means is releasedly engageable from each of said stop blocks when said ski(s) are positioned between said trace-reins rearwardly from said splitter, forwardly from said means, such that the rear of said stop block impinges upon said means prior to pull-up.

14. A device as in claim 13 wherein the upstanding body portion has a rear wall which has rounded corners and which slopes forwardly from the bottom to the top thereof.

15. In a water ski towing device of the type for towing a person on a ski(s) from an initial pull-out position to a planing position, a tow line assembly including a tow line adapted to be secured to a prime mover, a pair of trace-reins each connected on one end to said tow line, and on the opposite end connected to handle means, a splitter connected at its opposite end to each of said trace-reins, each end of said splitter being equidistant from said tow line, and spaced apart from said handle means, and a crossrope connected at the opposite ends thereof to each of said trace-reins, being releasably engageable with a stop block(s) on said ski(s), said means being substantially longer than said splitter and having an arcuate portion therein, wherein the crossrope is secured to one trace-rein, from which point it passes through a central bore down the length of said splitter, becomes disposed within and secured to said second trace-rein at a point equidistant from said tow line as is the point of egress from said first trace-rein just mentioned, is disposed rearwardly within said second trace-rein to a point of egress wherein it becomes disposed in a general direction toward said first trace-rein to a point on said first trace-rein substantially equidistant from said tow line as is said point of egress from said second trace-rein, at which it enters said first trace-rein and becomes disposed therein forwardly to a point of attachment on said first trace-rein, which point of attachment is downstream from the first point of securement of said rope to said first trace-rein, and wherein the crossrope is secured to the trace-reins by splicing, and wherein the trace-reins terminate at the opposite ends thereof in one or more handle assemblies.

16. A water ski towing device for towing a person on a ski(s) from an initial pull-out position to a planing position, comprising in combination with said ski(s) a stop block secured to the toe portion of each water ski, said stop block including a base for securing said block to said ski, and an upstanding body portion projecting above the surface of said ski, and integral with said base; and a towline assembly comprising a tow line adapted to be secured to a prime mover, a pair of trace-reins each connected on one end to said tow line at a bight, and on the opposite end connected to handle means, and a crossrope one end of which is spliced to one trace-rein and the other end of which is spliced to the other trace-rein, both splices being intermediate the bight and the handle means, and said crossrope having an arcuate portion therein, wherein said crossrope is releaseably engageable from the stop block on each ski when said ski(s) are positioned between said trace-reins, forwardly from said crossrope and rearwardly from said bight such that the rear of said stop block impinges upon said crossrope prior to pull-up.

* * * * *